US012496510B2

(12) United States Patent
Teeven

(10) Patent No.: US 12,496,510 B2
(45) Date of Patent: Dec. 16, 2025

(54) GLOW GOLF FISHING GAME

(71) Applicant: Anthony Teeven, Oblong, IL (US)

(72) Inventor: Anthony Teeven, Oblong, IL (US)

( * ) Notice: Subject to any disclaimer, the term of this patent is extended or adjusted under 35 U.S.C. 154(b) by 286 days.

(21) Appl. No.: 18/164,203

(22) Filed: Feb. 3, 2023

(65) Prior Publication Data

US 2023/0182003 A1 Jun. 15, 2023

(51) Int. Cl.
*A63F 9/30* (2006.01)

(52) U.S. Cl.
CPC ..... *A63F 9/305* (2013.01)

(58) Field of Classification Search
CPC ..... A63F 9/30; A63F 9/305
USPC ..... 273/330, 331, 332, 335, 343, 407
See application file for complete search history.

(56) References Cited

U.S. PATENT DOCUMENTS 1,380,154 A * 5/1921 Laval ..... A63F 9/305 273/140
1,551,685 A * 9/1925 O'Brien ..... A63F 9/305 273/140
1,557,788 A * 10/1925 Atkin ..... A63F 9/0208 273/338
2,107,672 A * 2/1938 Lang ..... A63F 9/34 446/139
2,146,194 A * 2/1939 Rubens ..... A63F 9/305 273/140
2,482,057 A * 9/1949 Fincke ..... A63F 9/0204 273/393
2,598,487 A * 5/1952 Anechiarico ..... A63F 9/34 446/132
4,032,144 A * 6/1977 Moustakas ..... A63F 9/305 273/447
4,898,392 A * 2/1990 Goletz ..... A63B 63/08 273/123 R
4,984,787 A * 1/1991 Nesbit ..... A63B 63/083 473/481
5,094,461 A * 3/1992 Lowrance ..... A63F 9/305 273/393
5,102,148 A * 4/1992 Mizunuma ..... A63F 9/30 273/447
5,141,465 A * 8/1992 Stellman ..... A63H 3/02 273/DIG. 30
5,180,170 A * 1/1993 Lowrance ..... A63F 9/305 273/393
5,615,881 A * 4/1997 Potter ..... A63F 9/305 273/140

(Continued)

*Primary Examiner* — Joseph B Baldori
(74) *Attorney, Agent, or Firm* — Dunlap Bennett & Ludwig PLLC; Anna L. Kinney

(57) ABSTRACT

A glow golf fishing game set includes a stand, luminescent hoops, and a pole. The stand includes two or more formed rods, positioned vertically, and a straight rod with evenly spaced attachment parts. The pole includes a filament mounted to one end, with an attachment part attached to a second end of the filament. Each formed rod has a loop in it. The straight rod is suspended horizontally through the loops. A method for playing the game includes mounting the hoops on hooks; positioning a player a distance from the stand; casting the filament towards the hoops; and assigning a number of points to the player based on an outcome of the cast. Play is repeated until a number of casts are complete; all players have cast, and one player achieves a predetermined score obtained by summing the assigned points.

9 Claims, 3 Drawing Sheets

(56) References Cited

U.S. PATENT DOCUMENTS

| | | | | | |
|---|---|---|---|---|---|
| 5,657,995 | A * | 8/1997 | Howard | A63F 9/305 | 446/311 |
| 6,550,774 | B1 * | 4/2003 | Stroll | G07F 17/3297 | 273/447 |
| 6,682,384 | B2 * | 1/2004 | Wang | A63H 33/18 | 446/46 |
| 6,840,648 | B2 * | 1/2005 | Bryant | G09F 21/02 | 63/3.1 |
| 7,011,310 | B2 * | 3/2006 | Rowan | A63B 63/004 | 473/476 |
| 7,484,733 | B2 * | 2/2009 | Lowrance | A63F 9/305 | 273/343 |
| 7,708,278 | B2 * | 5/2010 | Norbits | A63F 9/305 | 273/140 |
| 8,162,318 | B1 * | 4/2012 | Peterson | A63B 67/06 | 273/343 |
| 11,666,813 | B2 * | 6/2023 | Christoph | A63B 67/06 | 273/332 |
| 2011/0074109 | A1 * | 3/2011 | Werth | A63B 59/30 | 273/336 |
| 2013/0185987 | A1 * | 7/2013 | Downs | A01K 85/01 | 43/17.6 |
| 2016/0271489 | A1 * | 9/2016 | Estes | A63F 9/305 | |
| 2019/0091534 | A1 * | 3/2019 | Kinner | F41J 5/24 | |
| 2021/0346790 | A1 * | 11/2021 | Washington | A63F 9/34 | |

* cited by examiner

GLOW GOLF FISHING GAME

CROSS-REFERENCE TO RELATED APPLICATION

This application claims the benefit of priority of U.S. provisional application number 63/264,863, filed Dec. 3, 2021, the contents of which are herein incorporated by reference.

BACKGROUND OF THE INVENTION

The present invention relates to physically interactive multiplayer outdoor games and, more particularly, to a glow golf fishing game.

Kids and adults around campgrounds or just sitting outside around a fire are often interested in playing a game together. Few new commercially available physically interactive games have been provided for outdoor use. None of the currently available games enable the players to fish without a body of water and/or without using dangerous metal hooks.

As can be seen, there is a need for a new physically interactive outdoor game for multiple players.

SUMMARY OF THE INVENTION

In one aspect of the present invention, a glow golf fishing game set comprises a stand including: two or more formed rods, each formed rod having a loop formed therein, positioned vertically; and a straight rod, having evenly spaced attachment members thereon, suspended horizontally through the loops of the two or more formed rods; luminescent hoops; and a pole having a first end of a filament mounted to one end, with another attachment member coupled to a second end of the filament.

In another aspect of the present invention, a method for playing a glow golf fishing game comprises providing the glow golf fishing game set; mounting the luminescent hoops on the hooks; positioning a player a predetermined distance from the stand; casting the filament from the predetermined distance towards the luminescent hoops; assigning a predetermined number of points to the player based on an outcome of the cast; repeating until a predetermined number of casts are complete; and repeating for remaining players until all players have completed the predetermined number of casts and one of said all players achieves a predetermined score obtained by summing the assigned predetermined number of points.

The glow golf fishing game of the present subject matter promotes the benefits of fishing without the risk of hooking a player on a sharp fishing hook. A player can "fish" even in the absence of a nearby body of water, while supporting wildlife conservation. Moreover, the game may be played at a campsite or in a residential yard, providing a healthy activity for children and adults to share after dark.

These and other features, aspects and advantages of the present invention will become better understood with reference to the following drawings, description, and claims.

DETAILED DESCRIPTION OF THE INVENTION

Figure 1:
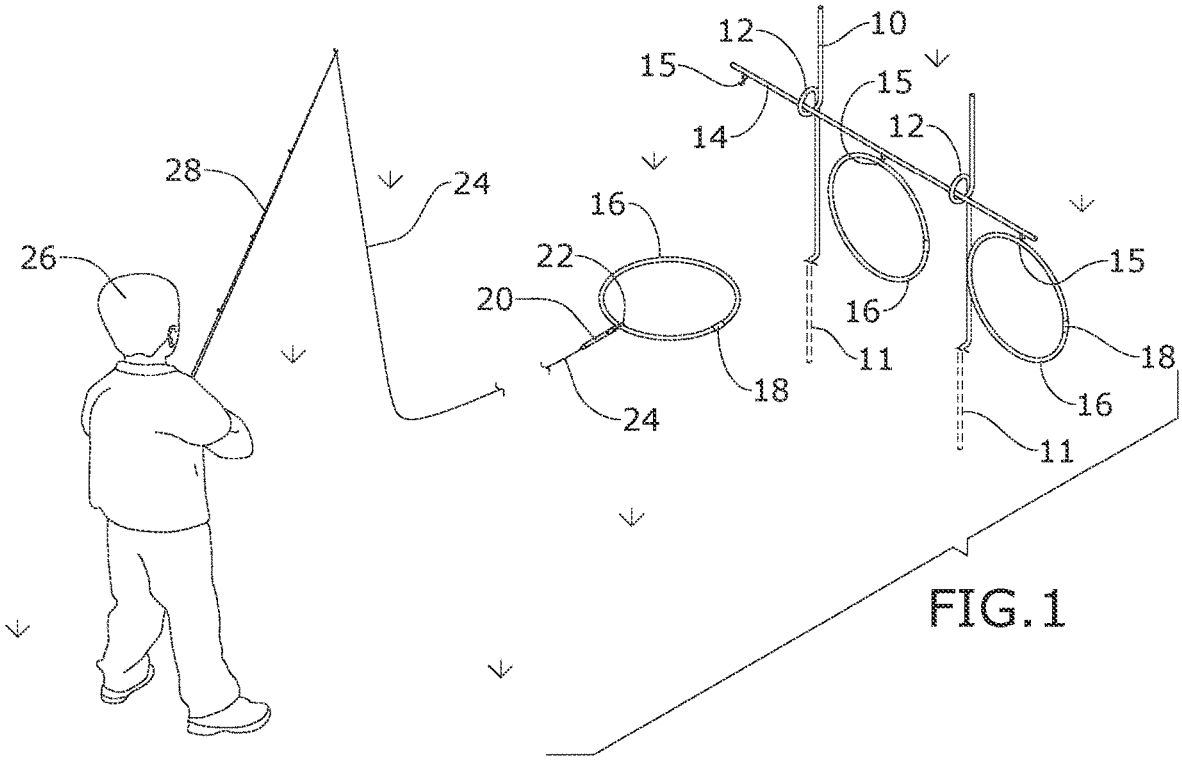
FIG. 1 is a perspective view of a glow golf fishing game set according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a glow fishing game for multiplayer outdoor play, comprising a game set. The game set may include a stand comprising two or more vertical formed rods having a loop formed therein and a straight rod with attachment members; luminescent loops; a pole with a filament mounted at one end, the filament having an attachment member at the opposite end. The straight rod may be suspended horizontally by inserting it into the loops of the vertical rods.

The stand may comprise any suitable material, such as metal rods. For example, ground rods may be used to manufacture the stand. In some embodiments, the stand may comprise wooden dowels, rigid plastic rods, and the like. In embodiments utilizing metal rods, the rods may be formed of any suitable metal, such as aluminum and/or stainless steel.

The vertical rods may be embedded into the ground (i.e., soil) for support or mounted to a base. In some embodiments, the vertical rods may have a stake portion configured to be embedded into the ground.

The attachment members may be blunt hooks affixed to the straight rod at evenly spaced intervals. In some embodiments, the attachment members may comprise any suitable attachment component, such as adhesive or magnets.

The luminescent loops may be formed, for example, from glow sticks with connectors coupling both ends of each glow stick together.

The pole may be a fishing pole or may resemble a fishing pole. The material of manufacture and the dimensions thereof are not particularly limited.

The filament may be any suitable line or string. A first end of the filament is generally mounted to one end of the pole, while a second end of the filament has an attachment member joined thereto. In some embodiments, the second end of the filament may have a luminescent component mounted thereto.

A method of preparing a glow fishing game set for play according to an embodiment of the present invention may include assembling the stand, mounting luminescent hoops on the stand, and assembling the fishing pole. The user may assemble the luminescent hoops by connecting both ends of a glow stick with a connector. The user may assemble the fishing pole by attaching a glow stick to an existing fishing pole filament and mounting a hook onto the glow stick. The user may place 2 or more ground rods, having a loop formed therein, vertically in the ground and may insert a straight rod horizontally through the ground rod loops. Once assembled, the game set forms a glow fishing game which may be played for entertainment.

A game according to an embodiment of the present invention may have a set of rules utilizing the inventive game set. The rules may include a predetermined distance a player is positioned from the stand. The player may cast the fishing pole line with the glowstick and hook towards the rings. Each turn may have a predetermined number of casts. Based on the outcome of each cast, a predetermined number of points may be awarded or deducted. For example, points may be assigned or deducted if the line and hook do not touch any of the rods or rings. If the player knocks a ring off the horizontal straight pole, the player or team may be awarded a predetermined number of points. If the player hooks a ring and detaches the connector from the glow stick, the player or team may be awarded a predetermined number of points. If the player hooks a ring and partially drags the ring, the player or team may be awarded a predetermined number of points. If the hook and line get caught on the game set or on another object, the player or team may have a predetermined number of points deducted. If the player hooks a ring already on the ground and successfully drags it back to the player, the player or team may be awarded a predetermined number of points. If a player successfully hooks a ring on the straight rod and brings it all the way back to the player, a predetermined number of points may be awarded. The player or team may take additional casts until the turn is completed. Play may continue until all players or teams have taken a turn. If all the rings have been knocked off the straight rod, the player or team to knock off the last ring may replace the rings to their starting, or initial, position. Play may continue until one player or team reaches a predetermined score determined as a sum of the assigned predetermine number of points for each cast. Alternatively, or in addition, play may continue until a player or team achieves a predetermined margin of points over the remaining player(s) or team(s) having the next highest number of points.

Referring to FIGS. 1 through 5, FIG. 1 illustrates a glow golf fishing game according to an embodiment of the present invention, shown in use. Luminescent hoops 16 are suspended from a stand comprising vertical rods and a horizontal rod 14. A player 26 is shown holding a fishing pole 28 having a luminescent hoop or glow ring 16 hooked to the fishing line 24 as the hoop 16 is dragged back towards the player.

Figure 2:
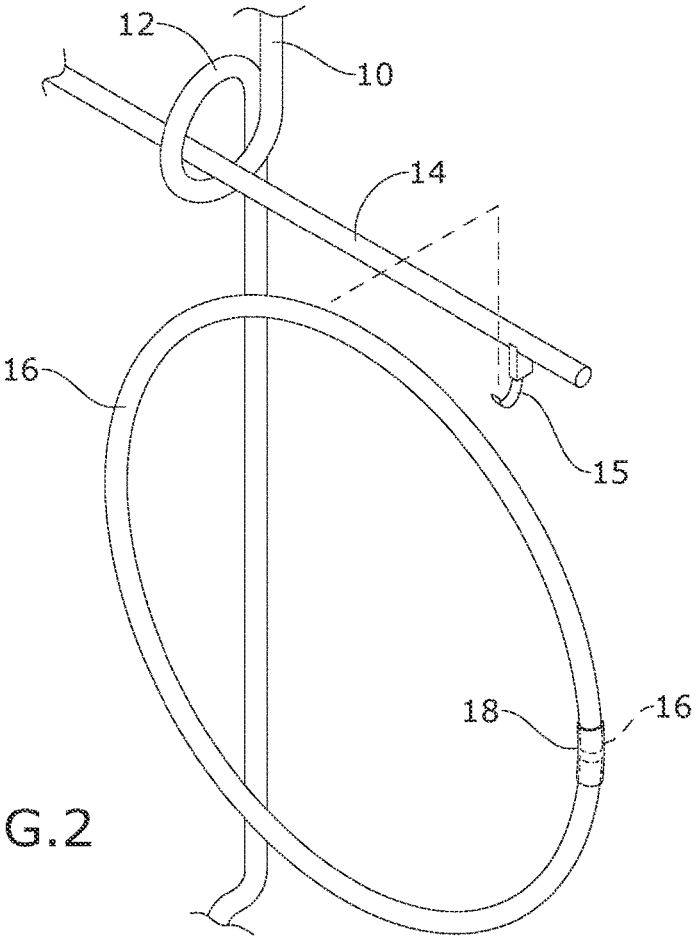
FIG. 2 is a detail exploded view thereof, showing a step of a method of setting up the glow golf fishing game according to an embodiment of the present invention.

An enlarged view of a portion of the set is shown in FIG. 2, illustrating the horizontal rod 14 mounted to the vertical rods 10 by resting within a loop 12. A luminescent hoop 16 formed by a glow stick 16 with a connector 18 coupled to both ends is also shown. The hoop 16 is mounted to the horizontal rod 14 by way of an attachment member, illustrated as a hook 15.

Figure 3:
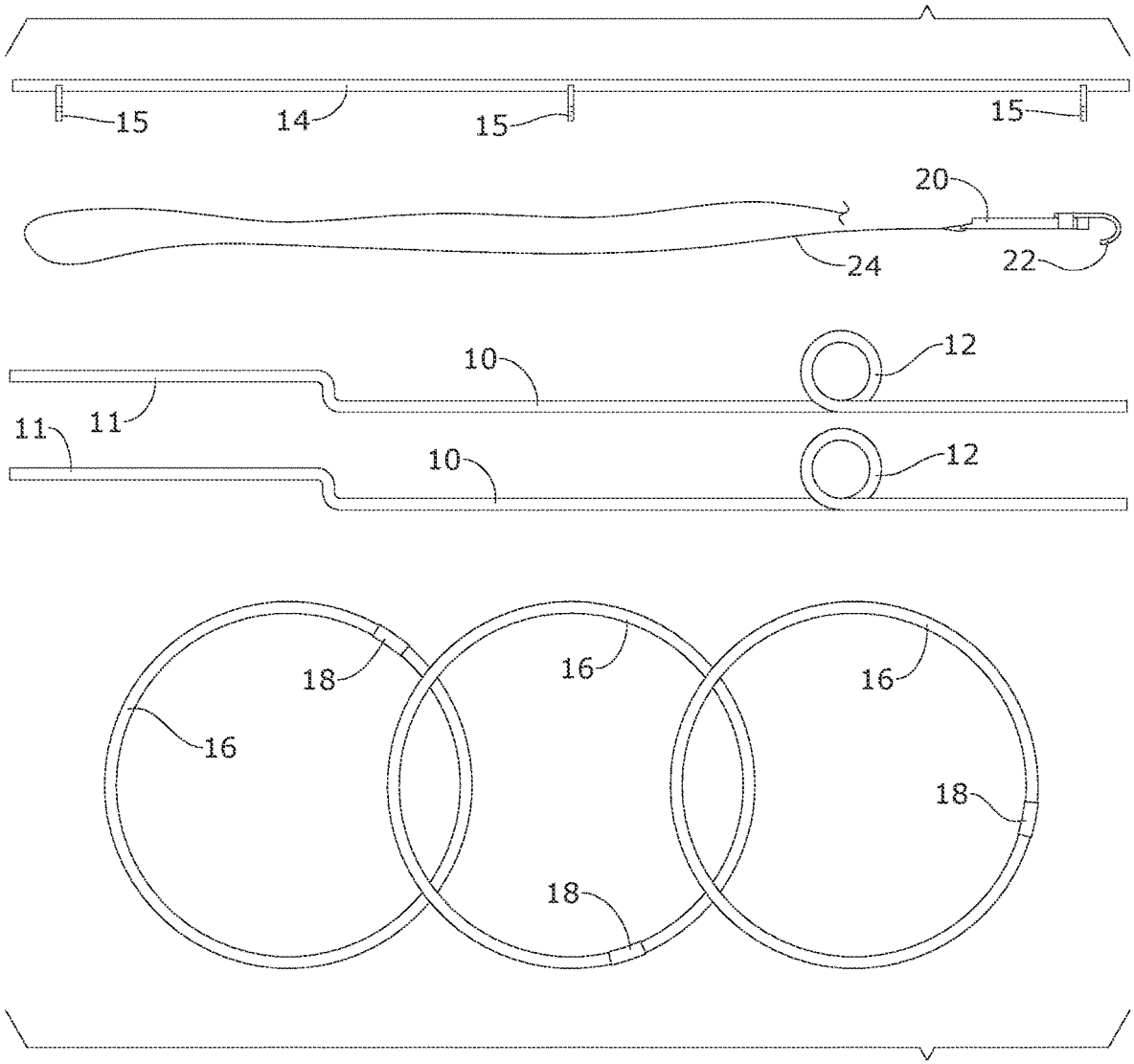
FIG. 3 is a top plan view thereof.

As best seen in FIG. 3, the components of the game set may include at least two identical integral rods 10, each having a stake portion 11 forming a shoulder at a junction with a main body portion of the rod 10 and a loop 12 formed therein; a straight rod 14 having hooks 15 evenly interspersed thereon; multiple luminescent hoops or rings 16 formed with connectors 18; and a fishing line, filament, or string 24 (the pole 28 is not shown in FIG. 3) with a luminescent member or glow stick 20 affixed at one end and a hook 22 mounted thereto.

Figure 4:
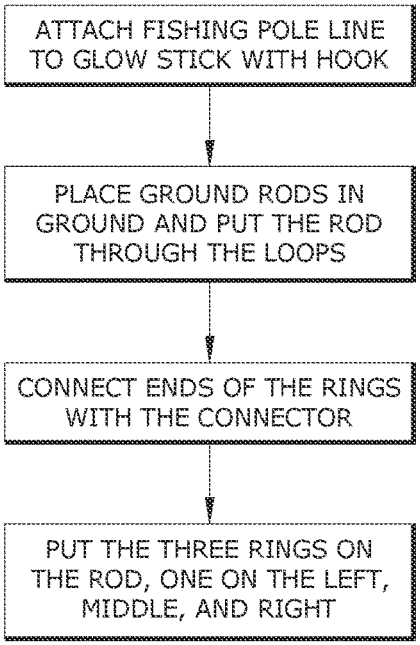
FIG. 4 is a flow diagram of the method of FIG. 2.

FIG. 4 provides the steps of a method of setting up the game according to an embodiment of the present invention. To prepare for play, the player may attach a fishing pole line to a glow stick with a hook. To assemble the stand, the player may place ground rods having parallel-formed loops in the ground and slide another rod through the loops in a horizontal position. To form the rings, the player may connect a connector to both ends of a glow stick. The player may then mount the rings on the horizontal rod. In this example, three rings are mounted at evenly spaced intervals—one to the left, one to the right, and one in the middle.

Figure 5:
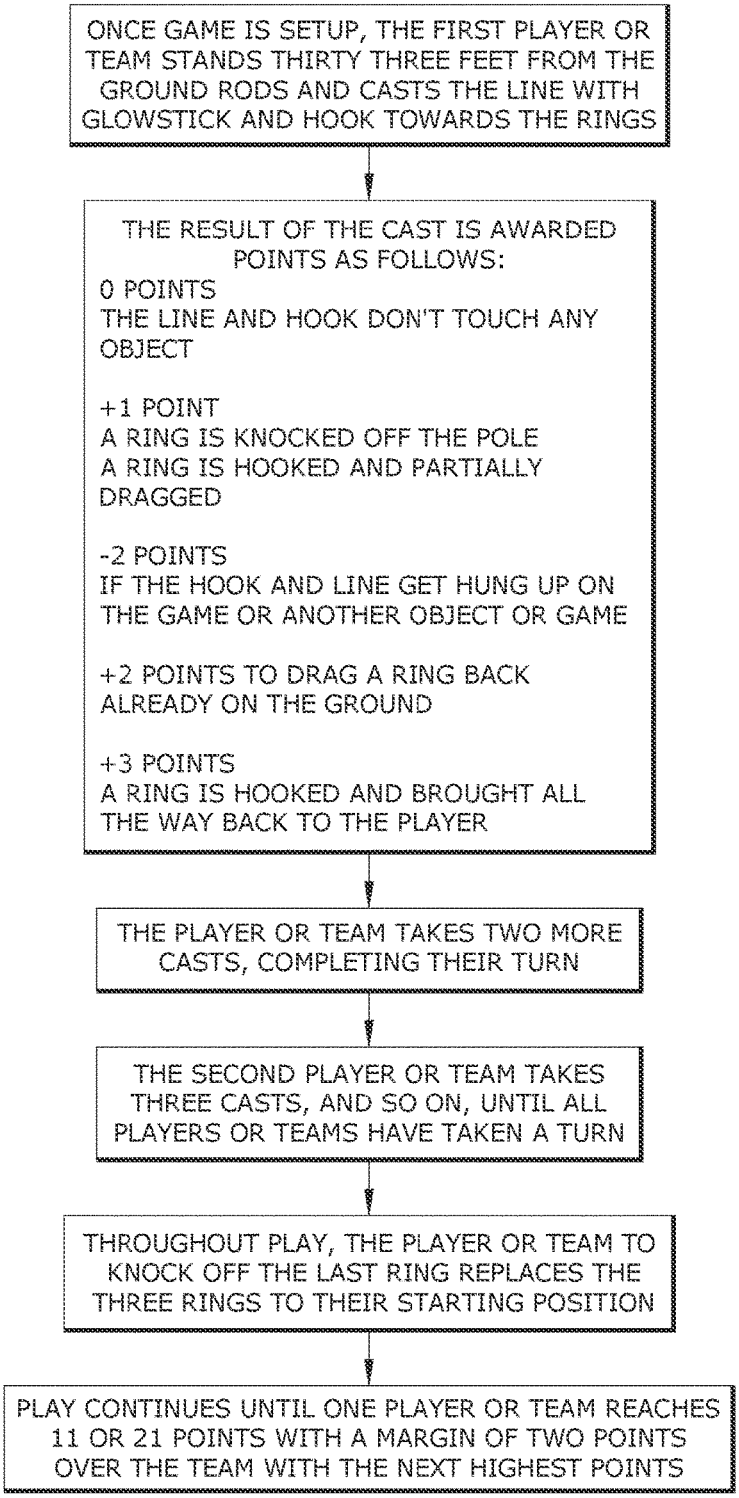
FIG. 5 is a flow diagram of a method of glow golf fishing game play according to an embodiment of the present invention.

The player may then play the game according to a method illustrated in the flowchart of FIG. 5. A first player or team may stand about 33 feet from the stand. Each turn may have 3 casts. The player may cast the fishing pole line with the glowstick and hook towards the rings. If the line and hook do not touch any of the rods or rings, the player or team may be assigned 0 points. If the player knocks a ring off the horizontal straight pole, the player or team may be awarded +1 point. If the player hooks the center ring and detaches the connector from the glow stick, the player or team may be awarded +1 point. If the player hooks a ring and partially drags the ring, the player or team may be awarded +1 point. If the hook and line get hung up on the game set or on another object, the player or team may be assigned −2 points. If the player hooks a ring already on the ground and successfully drags it back to the player, the player or team may be awarded +2 points. If a player successfully hooks a ring on the straight rod and brings it all the way back to the player, +3 points may be awarded. The player or team may complete their turn. The second player or team may take three casts, and so on, until all players or teams have taken a turn. If all the rings have been knocked off the straight rod, the player or team to knock off the last ring may replace the three rings to their starting position and continue play. Play may continue until one player or team reaches 11 or 21 points, with a two-point margin over the player or team with the next highest points.

It should be understood, of course, that the foregoing relates to exemplary embodiments of the invention and that modifications may be made without departing from the spirit and scope of the invention as set forth in the following claims.

What is claimed is:

1. A glow golf fishing game set, comprising:

a stand including:

two or more rods, each rod having a unitary structure comprising a main body portion, a stake portion integrally formed with the main body portion, and a loop formed as a continuous curved structure of the main body portion, the two or more rods being positioned in parallel vertically; and a straight rod, having evenly spaced blunt safety hooks thereon, wherein the straight rod is suspended horizontally in sliding engagement with the loops of the two or more rods;

luminescent hoops suspended from the evenly spaced blunt safety hooks; and a pole having a first end of a filament mounted to the pole, with a luminescent member and another blunt safety hook coupled to a second end of the filament;

wherein the blunt safety hook is configured to securely engage and release the luminescent hoops during gameplay while preventing injury to players.

2. The glow golf fishing game set of claim 1, wherein the rods comprise a main body portion and an integral stake portion configured to be embedded into soil for support, wherein a junction of the main body portion and the stake portion forms a shoulder.

3. The glow golf fishing game set of claim 1, wherein the blunt safety hooks have a curved structure dimensioned to securely engage and release the luminescent hoops during gameplay.

4. The glow golf fishing game set of claim 1, wherein the luminescent hoops comprise glow sticks, each having a first end and a second end coupled together with a connector.

5. The glow golf fishing game set of claim 1, wherein the pole is a fishing pole.

6. The glow golf fishing game set of claim 1, wherein the second end of the filament has a luminescent member mounted thereto.

7. The glow golf fishing game set of claim 1, wherein the luminescent hoops and the luminescent member on the filament are structurally configured as complementary luminescent components, with the luminescent hoops serving as stationary glowing targets and the luminescent member providing a moving glowing element.

8. The glow golf fishing game set of claim 1, wherein the stake portions have a pointed end configuration specifically dimensioned for hand-insertion into soil without tools.

9. The glow golf fishing game set of claim 1, wherein the loops have an internal diameter providing clearance around the straight rod.

* * * * *